United States Patent [19]

Ando

[11] Patent Number: 4,460,145

[45] Date of Patent: Jul. 17, 1984

[54] BOOK-HOLDER

[75] Inventor: Masumi Ando, Kashiwa, Japan

[73] Assignee: Hukuba Kogyo Kabushiki Kaisha, Chiba, Japan

[21] Appl. No.: 322,250

[22] Filed: Nov. 17, 1981

[30] Foreign Application Priority Data

Oct. 14, 1981 [JP] Japan ..... 56-163996
Oct. 19, 1981 [JP] Japan ..... 56-166933

[51] Int. Cl.[3] ..... A47B 19/00

[52] U.S. Cl. ..... 248/447; 108/5; 108/140; 312/233; 312/322; 248/242; 248/447.1

[58] Field of Search ..... 248/447, 293, 240, 240.1, 248/240.4, 448, 449, 242, 291; 312/322, 323, 133, 233; 108/5, 140, 48

[56] References Cited

U.S. PATENT DOCUMENTS

| | | | |
|---|---|---|---|
| 575,729 | 1/1897 | Palmer | 248/448 |
| 1,036,367 | 8/1912 | Sterling | 248/293 |
| 1,180,057 | 4/1916 | McNamara | 248/449 X |
| 2,533,050 | 12/1950 | Runyen | 312/323 |
| 2,599,416 | 6/1952 | Saecker | 248/447 |
| 2,650,871 | 9/1953 | Holderegger | 312/322 |
| 2,689,157 | 9/1954 | DiCenso | 108/5 |
| 2,839,349 | 6/1958 | Culver | 312/323 |
| 3,524,692 | 8/1970 | Preston | 312/322 |
| 3,795,379 | 3/1974 | Gray | 248/242 |
| 3,908,954 | 9/1975 | Nix | 248/447 |
| 4,184,725 | 1/1980 | Spangler | 248/447 X |

*Primary Examiner*—J. Franklin Foss
*Assistant Examiner*—David L. Talbott
*Attorney, Agent, or Firm*—Wenderoth, Lind & Ponack

[57] ABSTRACT

A book holder includes a shelf for supporting literature on the upper surface thereof is attached to a mounting member by means of a bracket. The bracket retains the shelf capable in a manner to be switched from a use position whereat the shelf extends obliquely and forwardly from the mounting member to a non-use position whereat the shelf is housed under the mounting member. The bracket may be mounted on the mounting subject through a swivel mechanism, whereby the direction of orientation of the shelf may be changed when in the use position.

4 Claims, 27 Drawing Figures

BOOK-HOLDER

BACKGROUND OF THE INVENTION

The present invention relates to a book holder and more particularly to a book holder suitable for use when one stands up before a work table to perform an operation while reading literature.

A book holder of this type is used, for example, when one stands up before a cooking table to perform cooking while reading a cooking procedure or the like written in a cook-book. That is, if the cook-book is placed on the cooking table during cooking, the cook-book tends to be stained by materials to be cooked or the like and the space where the cook-book is placed cannot be used, thus hampering cooking. To overcome this problem, the structure shown in FIG. 1 has been proposed heretofore.

In FIG. 1, there is shown a book-rest 1, which comprises a member having an L-shaped lateral longitudinal section, and a pair of support levers 2 and 3 pivotally mounted on side edges thereof at a central portion and at a rear portion thereof, respectively, such support levers being pivotally mounted on the bottom 6 of a suspended shelf 5 above a work table 4. In cooking on the table 4, the cook 7 draws the book-rest 1 forwardly above the cooking table 4 to direct a cook-book placed thereon forwardly and upwardly as shown in FIG. 1. In this manner, the cook-book may be retained without staining the cook-book and without hampering the cooking operation. When the book-rest 1 is not used, the book-rest 1 is forced rearwardly, and an iron element 9 of the book-rest is attracted by a magnet element 8 secured to the bottom 6 of the suspended shelf 5 as shown in FIG. 2 to thereby retain the book-rest 1. In this manner, the book-rest 1 may be disposed so as not to hamper the cooking operation when the book holder is not used.

In the prior art structure of FIG. 1, however, the position and direction of the book-rest 1 while in the use state are determined by the folding operation of the support levers 2 and 3 and by the weight of the book-rest 1 and the cook-book placed thereon, and therefore the stability of the book-rest 1 is poor.

In addition, in the structure of FIG. 1, it is not possible to completely house the book-rest 1 when not in use merely by forcing the book-rest 1 rearwardly, and care must be taken to insure that the iron element 9 is attracted by the magnet element 8. Thus, in the structure of FIG. 1, the book-rest 1 must be handled with care, resulting in an inconvenience in practical use.

Moreover, in the structure of FIG. 1, the support levers 2 and 3 pivotally mounted on opposite side edges of the plate-like book-rest 1 are folded to move the book-rest 1 to the use state or to the non-use state. As a consequence, the direction of movement of the book-rest 1 is always limited to the forward and rearward directions and the book-rest cannot be moved in the lateral directions. Accordingly, when the cook moves laterally with respect to the cooking table 4, the cook-book must be read from an obliquely lateral direction and therefore the content of the cook-book is difficult to read.

Furthermore, in the structure of FIG. 1, the mounting position of the support levers 2 and 3 on the bottom plate 6 must be inevitably set in consideration of the fact that the book-rest 1 must be housed beneath the bottom plate 6. Thus, if the eyes of the cook 7 are at a high level as shown by A1 in FIG. 1, the rear end of the book-rest 1 comes within a dead angle $\theta$, and hence, the cook when desiring to read an article in the cook-book within the range of such dead angle must take a lowered posture to lower the level of his eyes to a lower position as indicated at A2, thus requiring an additional cumbersome operation.

It would be preferably supposed that in order to avoid such difficulties, the book-rest 1 could be extended outwardly as indicated at K by the dotted lines in FIG. 1 so that the cook-book then would not be within the range of the dead angle $\theta$. However, when the book-rest 1 then is housed under the suspended shelf 5, the extended portion K would protrude forwardly of the suspended shelf 5 as shown in FIG. 2. Therefore, the external appearance becomes poor when housed, and in addition the operation of the cooking table 4 possibly would be greatly hampered by the protrusion of the book-rest 1 when not in use (because the dead angle on the cooking table 4 would be enlarged when the book holder is not in use).

Incidentally, generally speaking, the dimension D of the depth of the suspended shelf is normally about 300 mm, and thus the length L of the book-rest must be less than 300 mm in order that the book-rest 1 not protrude from the suspended shelf 5 when housed. Accordingly, the problem of the dead angle $\theta$ at the position A1 in FIG. 1 cannot be solved.

OBJECTS AND SUMMARY OF THE INVENTION

It is therefore a primary object of the present invention to provide a book holder which can stably position a book-rest during use by a simpler operation than in prior art arrangements and which can readily house the book-rest under a mounting member.

The book holder according to the present invention is therefore designed so that a shelf for supporting literature thereon may be retained in an obliquely forwardly extended use position or in a substantially horizontally extended non-use position by means of a bracket mounted on a mounting or support member or body.

Particularly, in order that the book-rest may be operated to be switched simply between the use and non-use positions, the book holder of the present invention is designed so that the shelf is retained on the bracket so that the shelf may be slidably moved in a forward and rearward direction with respect to the bracket, whereby when the rear end of the shelf is retained by the bracket the shelf may assume an obliquely forwardly extended use position, and conversely when the forward end of the shelf is retained by the bracket the shelf may assume a non-use position where the shelf is extended horizontally to be housed under the mounting body. In this manner, the shelf may be moved to the use position merely by the operation of drawing it forwardly, and the shelf may be moved to the non-use position merely by the operation of pushing it rearwardly. Also, the book holder of the present invention is designed so that the bracket retains the shelf in a manner so as to be rotated integrally with the shelf. Thus, in the use position the shelf may be extended obliquely forwardly from the mounting body, whereas in the non-use position the shelf may be rotated to be housed beneath the mounting body. In this manner, the shelf may be housed beneath the mounting body by the simple operation of rotating the shelf.

It is a further object of the present invention to provide a book holder whereby when a cook moves laterally with respect to a cooking table, the direction in which the book-rest faces may be easily changed so that literature placed on the book-rest always faces the cook.

The book holder according to the present invention is therefore designed so that a bracket is mounted on the mounting body by means of a swivel mechanism.

It is still another object of the present invention to provide a book holder wherein a viewing dead angle with respect to literature placed on a book-rest in the use position is minimized.

The book holder according to the present invention is therefore designed so that a bracket is mounted on the mounting body by means of a swivel mechanism, whereby the book-rest may be rotated for housing it beneath the mounting body, and wings are mounted on the book-rest, such wings being closed when not in use.

BRIEF DESCRIPTION OF THE DRAWINGS

Other objects and advantages of the present invention will become apparent from the following detailed description of embodiments of the present invention, taken in connection with the accompanying drawings, in which.

DETAILED DESCRIPTION OF THE PREFERRED EMBODIMENTS

In the following, examples of the present invention will be described in detail with reference to the drawings.

Figure 3:
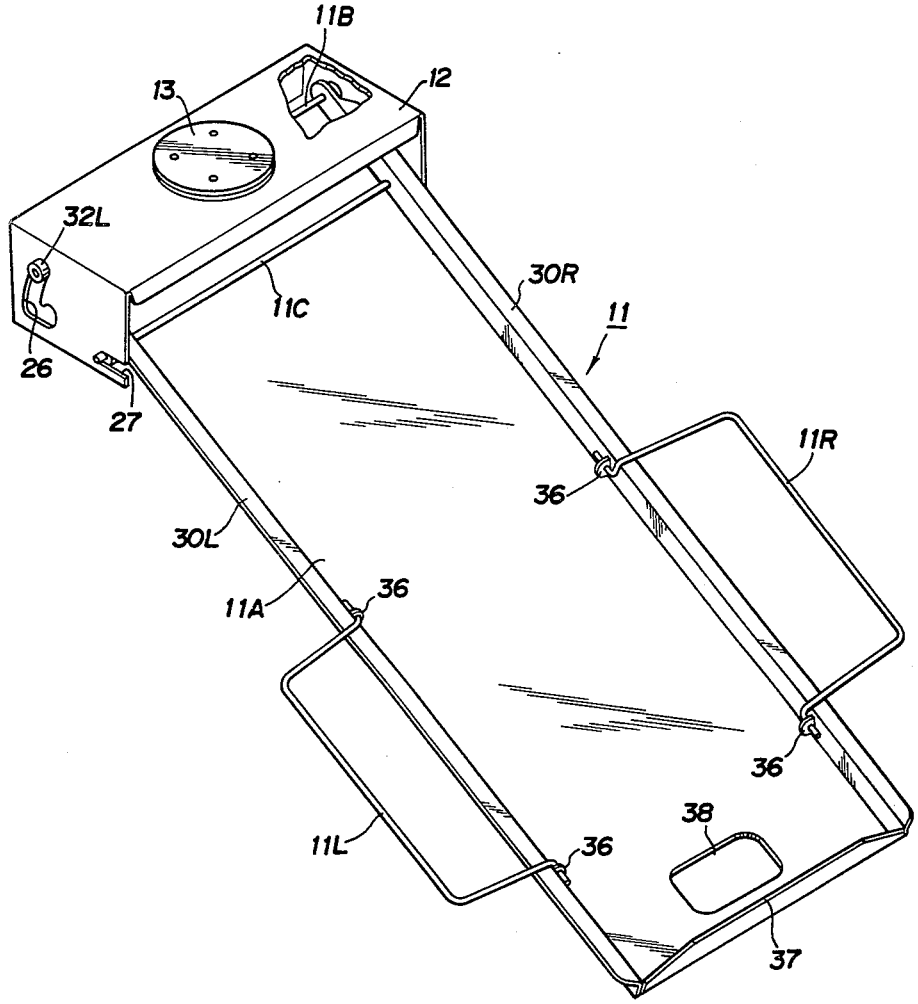
FIG. 3 is a perspective view showing a first embodiment of a book holder in accordance with the present invention.

FIG. 3 shows a first embodiment of a book holder in accordance with the present invention, the book holder comprising a book-rest 11, a bracket 12 for supporting a rear end thereof, and a swivel mechanism 13 for rotatably retaining the bracket 12.

Figure 5:
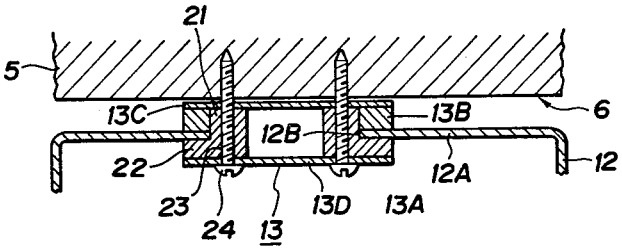
FIG. 5 is a fragmentary sectional view showing the details of a swivel mechanism.
Figure 4:
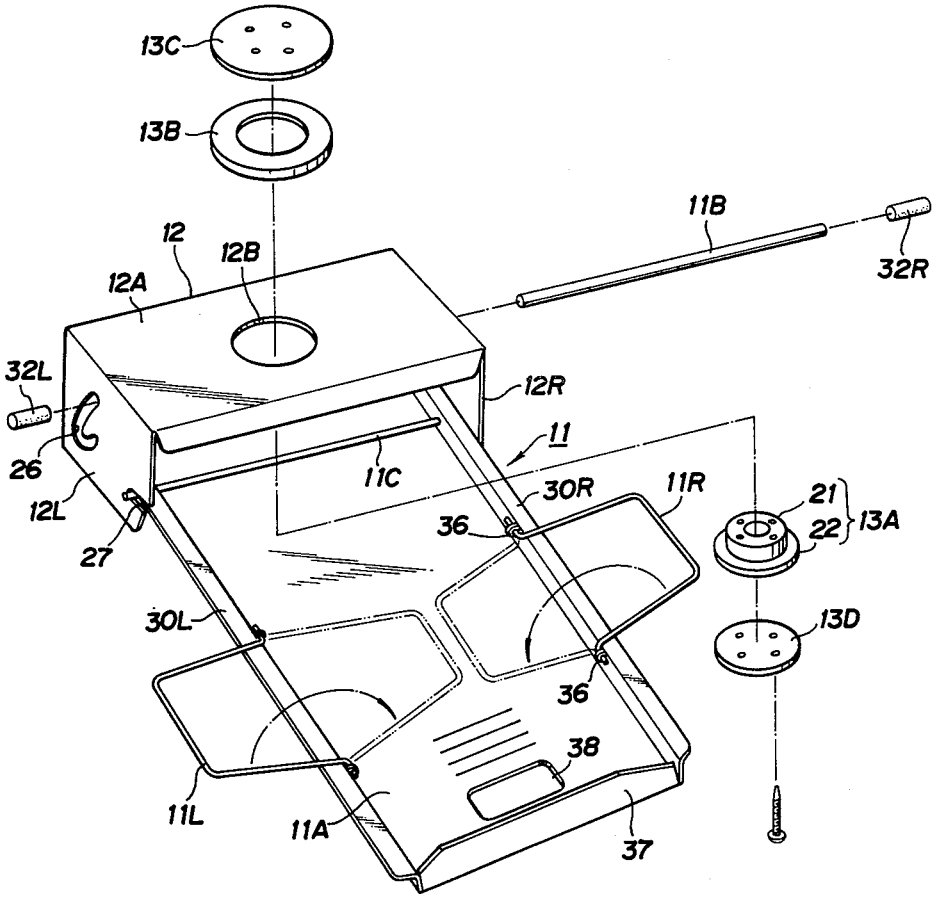
FIG. 4 is an exploded perspective view.

As shown in FIG. 4, the bracket 12 comprises a horizontal plate portion 12A extending laterally, and vertical plate portions 12L and 12R bent and extended downwardly from the left and right ends, respectively, of the horizontal plate portion 12A, the horizontal plate portion 12A being formed in a substantially central position thereof with a circular hole 12B in which the swivel mechanism 13 is mounted. The swivel mechanism 13 has a center shaft 13A composed of a shaft portion 21 rotatably fitted into the hole 12B and a flange portion 22 extending horizontally and outwardly from a lower end of the shaft portion 21, the center shaft 13A being fitted from the underside into the circular hole 12B of the horizontal plate portion 12A of the bracket 12 as shown in FIG. 5, with a center collar 13B being opposed to the flange portion 22 and with the horizontal plate portion 12A placed therebetween, and center collar 13B is rotatably fitted into the shaft portion 21. Washer plates 13C and 13D are placed on upper and lower ends, respectively, of the center shaft 13A, and wood screws 24 are screwed from the underside into four vertical holes 23 bored in the shaft portion 21 so that forward ends thereof are screwed into a bottom plate 6 of a suspended shelf 5, whereby the horizontal plate portion 12A of the bracket 12 may be stably rotated with respect to flange portion 22 of the center shaft 13A by the center collar 13B, with the result that the bracket 12 may swivel integrally with the book-rest 11.

On the other hand, the vertical plate portions 12L and 12R of the bracket 12 are formed at their rear portions with L-shaped holes 26 and at their forward positions with laterally extending long grooves 27. In the case of the illustrated embodiment, the long grooves 27 are open frontwardly.

Figure 6:
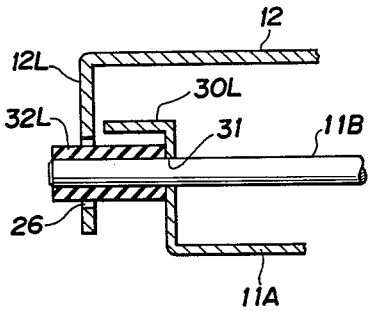
FIGS. 6 and 7 are fragmentary sectional views showing the construction in which a guide pin is attached to a bracket.

The book-rest 11 has a plate-like shelf 11A having both left and right side edges each bent so as to form an inverted-L in lateral section, and as shown in FIG. 6, a guide pin 11B laterally extends through holes 31 bored in upwardly rising plate portions in the rearmost ends of the left and right side edges 30L and 30R, the guide pin 11B having its left and right ends extended through respective L-shaped holes 26 of the vertical plate portions 12L and 12R of the bracket 12 so as to be extended outwardly of the bracket 12 to bear on the L-shaped holes 26 through rubber guide rollers 32L and 32R urged onto such extended ends, whereby the guide pin 11B and thus the rear end of the shelf 11A may be smoothly moved along the resultant L-shaped locus of holes 26 without play.

At positions forwardly of the holes 31 in the left and right side edges 30L and 30R of the shelf 11A, there are formed holes 33 (FIG. 7), and a guide pin 11C laterally extends through the holes 33, the guide pin 11C having left and right ends extended through the long grooves 27 in the vertical plate portions 12L and 12R of the bracket 12 so as to be extended outwardly of the bracket 12, whereby the guide pin 11C is stopped at the long grooves 27 and the shelf 11A may be vertically moved about such stopped position. Guide pin 11C, when the shelf 11A is drawn forwardly or forced backwardly, can be guided along the long grooves 27 for lateral movement whereby as the rear guide pin 11B is moved in response to the lateral movement or vertical rotation of the shelf 11A, the rotative center by the guide pin 11C may be displaced within the long grooves 27.

Figure 7:
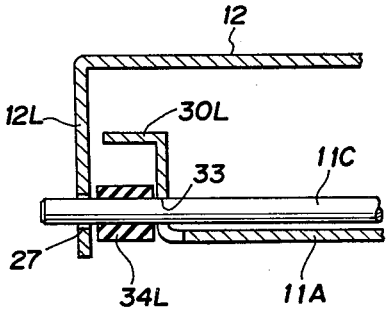
Figure 8:
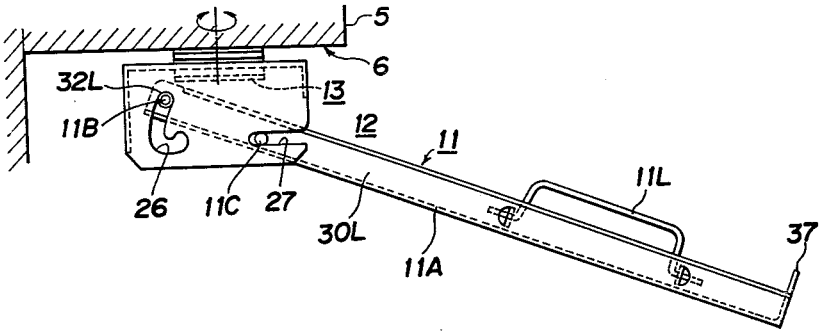
FIGS. 8 and 9 are side views showing a book-rest in a use position and in a non-use position, respectively.

As shown in FIG. 7, rubber stop collars 34L and 34R are interposed under pressure between the left and right vertical plate portions 12L and 12R of the bracket 12, whereby the guide pin 11C may be smoothly moved within the grooves 27 without play.

The book holder constructed as described above is assembled as follows: First, the center shaft 13A is inserted into the circular hole 12B of the bracket 12 from the underside of the bracket 12, the center collar 13B is inserted from above, and the washer plates 13C and 13D are held from upper and lower portions thereof and thereafter they are secured to the bottom plate 6 of the suspended shelf 5 by means of the wood screws 24.

Next, wings 11L and 11R are attached to the shelf 11A and the guide pin 11C and stop collars 34L and 34R are mounted, after which the guide pin 11C is inserted into the long grooves 27 from front side, whereby the shelf 11A is retained by the long grooves 27. Thereafter, the guide pin 11B is inserted into the holes 31 in the shelf 11A through the guide grooves 26 of the bracket 12, and the guide rollers 32L and 32R are forced onto both ends of the guide pin 11B through the guide grooves 26, thus completing the assembly.

In this way, the book holder may be assembled easily without requiring special skills.

With the foregoing arrangement, in use of the book holder, when the front end of the shelf 11A is slightly raised and pushed backward and then rotated downwardly, the rear shaft 11B of the shelf 11A assumes a position wherein it is stopped at the upper portion of the L-shaped guide grooves 26. Thus, the shelf 11A is maintained in a state where the front end thereof extends obliquely frontwardly and downwardly. In this position, when the wings 11L and 11R are opened outwardly, an effective area for receiving the cook-book is enlarged laterally, whereby the cook-book may be stably put on the book-rest 11.

In this position, when a cook moves to the right or left, the shelf 11A can be pushed laterally to cause it to swivel when necessary. At this time, the shelf 11A of the book-rest 11 undergoes a force by which it is rotated along with the bracket 12 since the bracket 12 can swivel over the flange 22 of the center shaft 13A. Here, the center collar 13B stably retains the bracket 12 on the center shaft 13A, and accordingly, the bracket 12 and thus the shelf 11A may swivel smoothly.

Thus, the cook can read the cook-book on the book-rest 11 directed toward him (or her) from substantially the front and accordingly, the cook can conduct cooking more comfortably.

Figure 9:
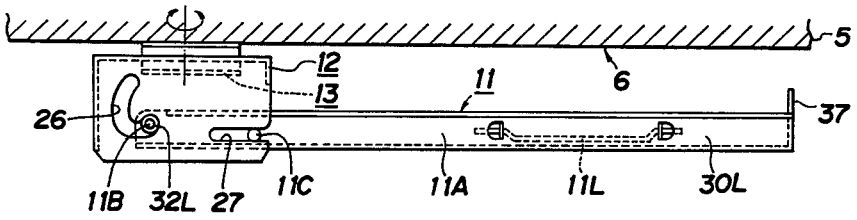
Figure 10:
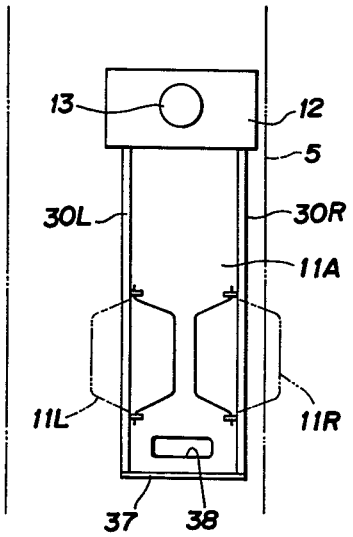
FIG. 10 is a plan view showing the relationship between the book-rest in a housed state and the mounting member.

When the book-holder is to be moved from the aforesaid use position, the wings 11L and 11R are folded over the shelf 11A and the shelf 11A is rotated upwardly until the forward end thereof assumes a substantially horizontal level and then is pulled out. Thus, as shown in FIG. 9, the shaft 11B at the rear of the shelf 11A comes into engagement with the front and lower ends of the L-shaped guide grooves 26 whereby the shelf 11A is locked in a substantially horizontal orientation. From this position, the shelf 11A is further rotated leftwards or rightwards so as to be positioned to extend in a substantially lateral direction. At this time, the shelf 11A entirely is installed beneath the bottom plate 6 of the suspended shelf 5.

Figure 1:
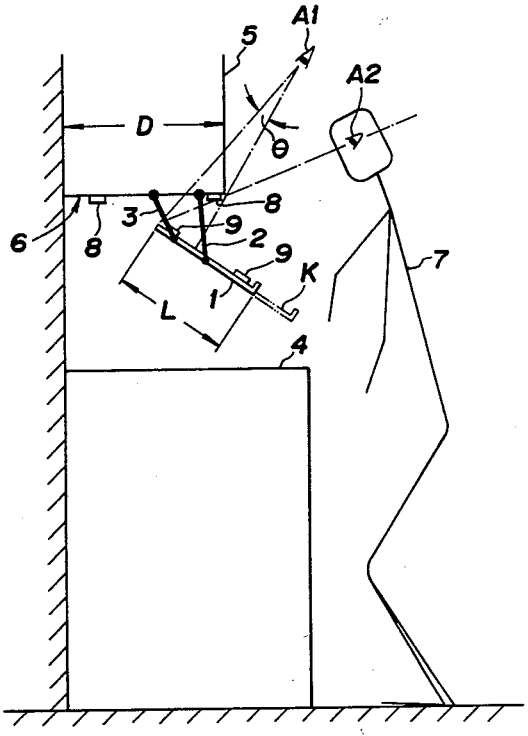
FIG. 1 PRIOR ART
FIGS. 1 and 2 are schematic side views showing a conventional book holder.
Figure 2:
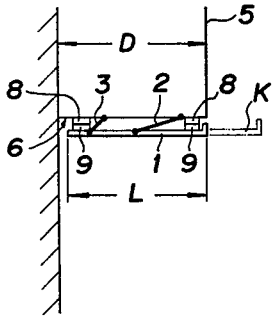
FIG. 2 PRIOR ART

As described above, in accordance with the book holder constructed as shown in FIG. 3, in the position of use where the book-rest 11 is drawn forwardly, when the cook moves laterally before the cooking table, the book-rest 11 can swivel easily, and therefore cooking can be conducted much more easily compared with the conventional book holder as mentioned above with reference to FIGS. 1 and 2.

Further, since the wings 11L and 11R are attached to the shelf 11A, it is possible to locate the cook-book stably thereon even if a relatively narrow shelf 11A is used.

Figure 11:
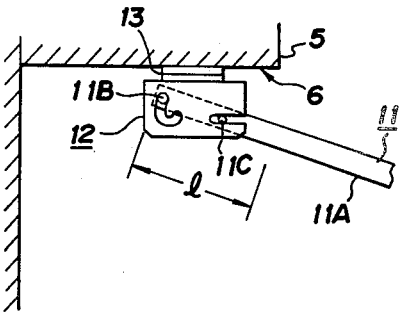
FIG. 11 is a fragmentary side view showing the relationship between the book-rest in a use position and the mounting member.

In addition, by a combination of the provision of the wings 11L and 11R on the shelf 11A and the achievement of storing the shelf 11A by making use of a rotation operation, it is possible to provide a book holder which has a much smaller dead angle and the overall structure of which is much smaller than those of the prior art. Incidentally, since the wings 11L and 11R are laterally spread when in use and are folded onto the narrow shelf 11A when not in use, the position of mounting the bracket 12 on the suspended shelf 5 can be relatively forwardly of the shelf and need not be at the inner or rearward portion thereof. The reason is that in the stored state with the shelf 11A turned laterally, the width of the shelf 11A can be narrowed by the extent by which the wings 11L and 11R are folded or spread outwardly. Thus, the bracket 12 is not forced out frontwardly of the suspended shelf 5 even if the bracket is mounted in the vicinity of the front of the suspended shelf 5. Moreover, this means that, as shown in FIG. 11, in the position of use where the shelf 11A is drawn forwardly, that portion l of the book holder opposed to the bottom plate 6 is small, and accordingly, the dead angle of the book-rest 11 becomes small.

It should be further noted that a finger hole 38 is provided at the forward end of the shelf 11A, whereby the cook may thrust his finger into the finger hole 38 to grip the shelf 11A thus facilitating the operations of drawing out and pushing in and vertically rotating the shelf 11A.

Figure 12:
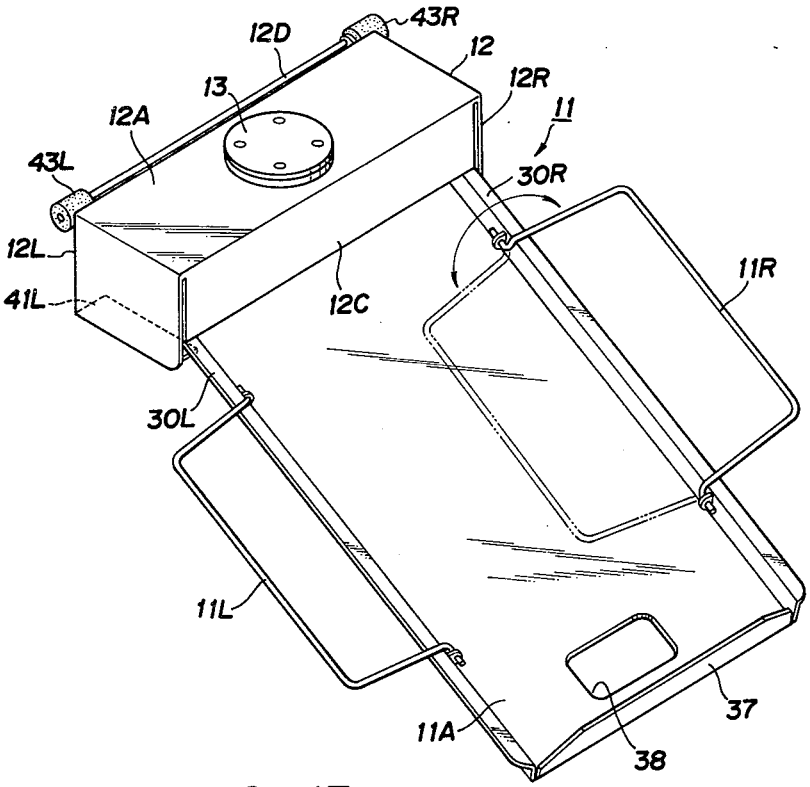
FIG. 12 is a perspective view showing a second embodiment of the book holder in accordance with the present invention.
Figure 14:
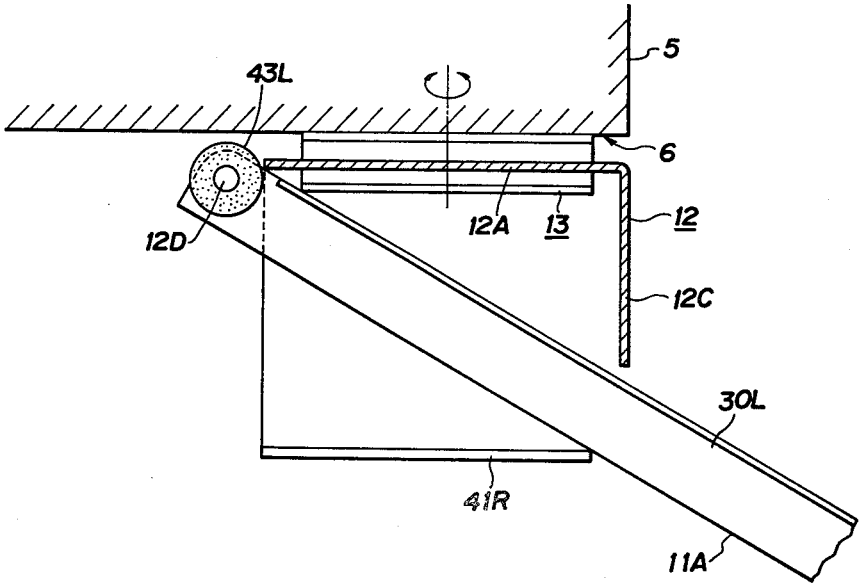
FIGS. 14 and 15 are fragmentary side views partly in section showing the relationship between a shelf in a use position and a non-use position, respectively, and a bracket.

FIG. 12 illustrates a second embodiment of the book holder in accordance with the present invention. In this embodiment, the bracket 12 is mounted on the bottom plate 6 of the suspended shelf 5 by the swivel mechanism 13 at a position where the front plate portion is substantially aligned with the front surface of the suspended shelf 5, as shown in FIG. 14. Accordingly, if the cook moves before the cooking table when using the book holder, the book-rest may be swiveled in the direction of such movement, in a manner similar to that described above in connection with FIG. 3.

Figure 13:
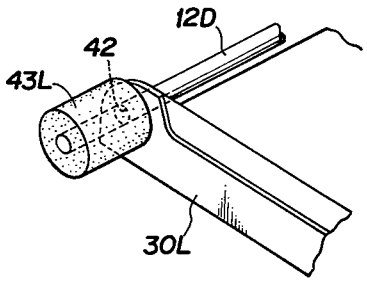
FIG. 13 is a fragmentary perspective view showing the mounting construction of a shaft and a roller.

In this case, however, the construction in which the shelf 11A is connected to the bracket 12 is different from that of FIG. 3. That is, the bottom ends of the vertical plate portions 12L and 12R of the bracket 12 are inwardly bent at right angles in a substantially horizontal direction to form bent plate portions 41L and 41R, and the front plate portion 12C of the bracket 12 extends downwardly from the horizontal plate portion 12A to a position adjacent the left and right side edges 30L and 30R of the shelf 11A. However, the shelf 11A laterally extends through the bracket 12 through a clearance between the front plate portion 12C and the bent plate portions 41L, 41R. The vertical plate portions of the left and right side edges 30L and 30R at the rearmost end of the shelf 11A have axial holes 42 bored therein as shown in FIG. 13, and a rotatable shaft 12D extends through axial holes 42. Rubber rollers 43L and 43R are forced onto left and right extended ends of the shaft 12D so that the rollers 43L and 43R are rotated integral with the shaft 12D.

The book holder constructed as shown in FIG. 12 is assembled in a manner as follows: First, the bracket 12, with the swivel mechanism 13 assembled thereon in a manner similar to that described above, is secured to the bottom plate 6 of the suspended shelf 5. The rear end of the shelf 11A with the wings 11L and 11R attached thereto (at this time, the shaft 12D and rollers 43L, 43R are not yet attached) is then inserted into the underside of the front plate 12C of the bracket 12 and extended therethrough rearwardly, and in this extended state, the shaft 12D and rollers 43L, 43R are forced into the rear end of the shelf 11A to complete the assembly of the book holder.

With the foregoing arrangement, in use of the book holder, the shelf 11A is drawn forwardly from the bracket 12, and the wings 11L and 11R are opened to left and to right. At this time, the rollers 43L and 43R at the rear end of the shelf come into contact with the upper back face of the bracket 12 as shown in FIG. 14, and the shelf 11A is supported, as it extends obliquely and downwardly, on the front ends of lower plate portions 41L and 41R. Accordingly, the forward portion of the shelf 11A moves out of the bracket 12 and extends obliquely, forwardly and downwardly, and the cook-book supported by the shelf 11A and wings 11L, 11R may be held in an obliquely, forwardly and downwardly direction position.

In this state, the cook may rotate the shelf 11A while moving laterally before the cooking table, and the book-rest 11 swivels so that the cook-book is directed towards the cook. Thus, the cook can always continue cooking while reading the cook-book which is in an easily readable position.

Figure 15:
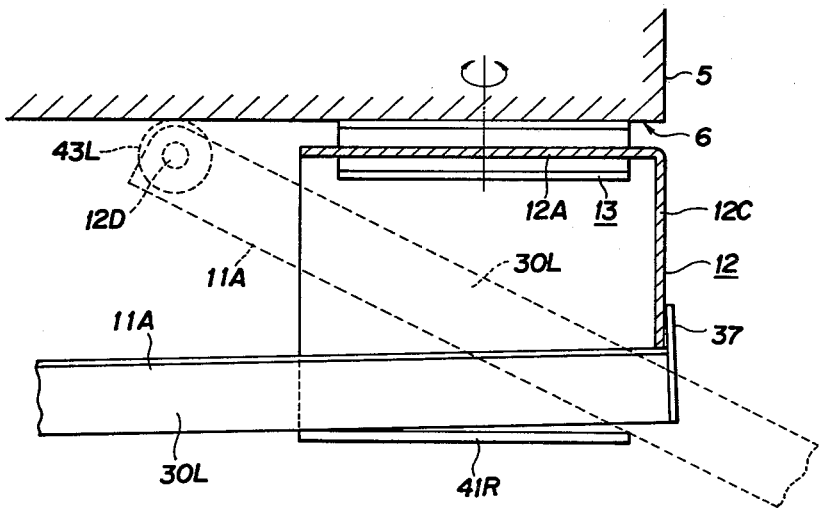

From this use state, the book-rest 11 may be housed under the suspended shelf 5 by forcing the shelf 11A inwardly towards the bracket. At this time, the book receiving plate 37 at the forward end of the shelf 11A comes into contact with the front plate 12C of the bracket 12 as shown in FIG. 15, but the rear portion of the shelf 11A extends rearwardly of the bracket 12 and as a consequence it inclines downwardly therefrom by its own weight and is held on the bracket 12 when the left and right side edges 30L and 30R come into contact with the lower end of the front plate 12C. In this position, if the bracket 12 is viewed from the front, the shelf 11A does not extend forwardly from the bracket 12, and thus cooking is never hampered.

When the book-rest 11 is forced into the bracket 12 from the use state, the rollers 43L and 43R attached to the rear end of the shelf 11A roll in contact with the bottom plate 6 of the suspended shelf 5 as shown by the dotted lines in FIG. 15 to guide the shelf 11A rearwardly, and therefore the shelf 11A can be smoothly housed under the suspended shelf without damaging the bottom plate 6.

While in the embodiment shown in FIG. 12, the shelf 11A has been forced rearwardly without rotation of the bracket 12 to extend the shelf 11A into the bracket 12, it should be appreciated that the bracket 12 first may be rotated to a laterally extending orientation in a manner similar to the embodiment of FIG. 3, after which the shelf 11A may be extended laterally through the bracket 12.

While also in the embodiment shown in FIG. 12, the rollers 43L and 43R have been forced onto both ends of the shaft 12D extended outwardly from the left and right side edges 30L and 30R of the shelf 11A, it should be appreciated that instead thereof or along therewith, similar rollers can be disposed between the left and right side edges 30L and 30R of the shaft 12D to achieve similar results.

In addition, while in the embodiments shown in FIGS. 3 and 12, the description has been given with respect to the case where the present invention is applied to a book holder for holding a cook-book, the present invention is not limited thereto but may be widely applied to other situations where a person stands before a work table to perform an operation while reading literature such as, for example, for the dispensation of a variety of drugs.

As described above, according to the book holders shown in FIGS. 3 and 12, the book-rest may be drawn forwardly when in use, whereas it may be housed so as not to hamper work when not in use, and in addition the book-rest may be swiveled when in use. With such an arrangement, it is possible to readily provide a simple book holder with which only by a simple manipulation by an operator, literature placed on the book-rest always can be maintained in an easily readable orientation.

Furthermore, while in case of the book holders shown in FIGS. 3 and 12, the wings 11L and 11R are rotated for opening and closing movements thereof, the structure of the invention is not limited thereto, but rather the wings can be stored internally of the shelf when not in use and the wings can be extended outwardly of the shelf when in use, for example, such as by an arrangement wherein the wings slide to be extended outwardly.

Figure 16:
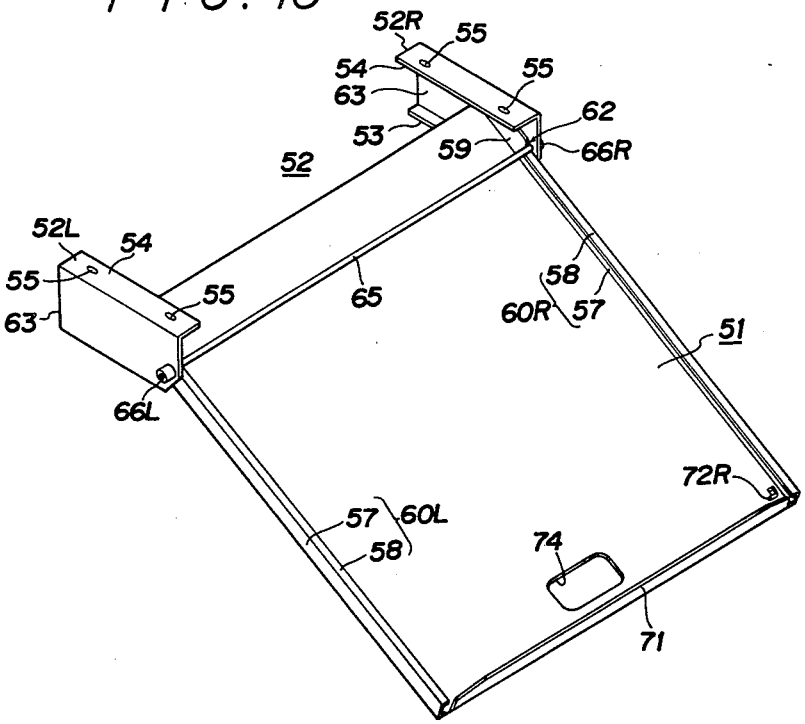
FIG. 16 is a perspective view showing a third embodiment of the book holder in accordance with the present invention.

FIG. 16 illustrates a third embodiment of a book holder in accordance with the present invention. In FIG. 16, a shelf 51 having a ⊏ -shaped lateral section is retained on the bottom plate 6 (FIG. 1) of the suspended shelf 5 by means of a bracket 52. The bracket 52 includes a pair of bracket elements 52L and 52R having ⊐ -shaped section with horizontal plate portions 53 and 54 directed inwardly. In this condition, the bracket is attached, from the underside thereof, to the bottom plate 6 of the suspended shelf 5 by means of screws 56 through tapped holes 55, to thereby retain shelf 51 between the horizontal plate portions 53 and 54 which face each other.

Figure 17:
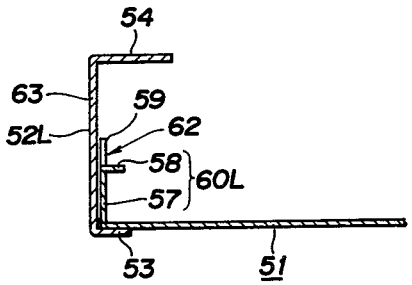
FIG. 17 is a fragmentary sectional view showing the relationship between a shelf and a bracket.
Figure 18:
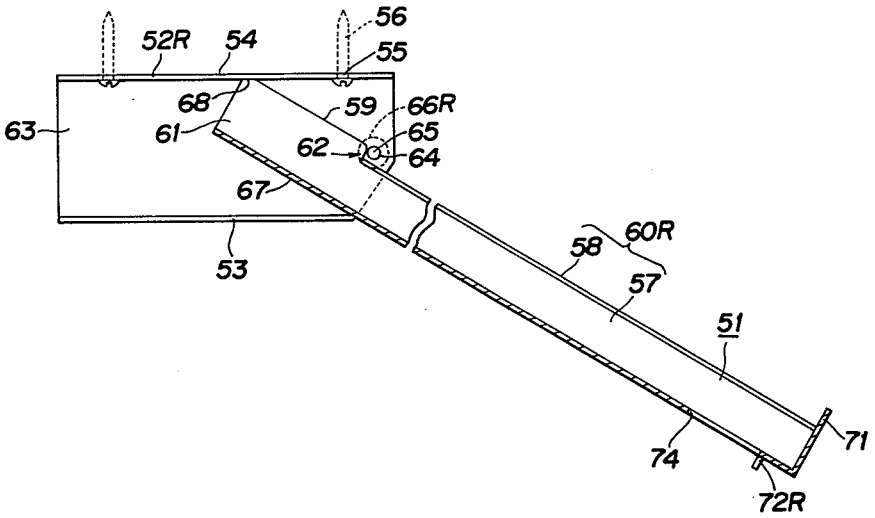
FIGS. 18 and 19 are longitudinal sectional views showing the relationship between the shelf in a use position and a non-use position, respectively, and the bracket.
Figure 19:
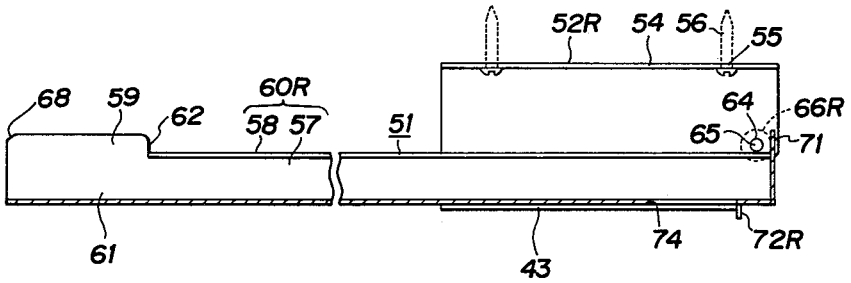

As shown in FIG. 17, the shelf 51 has left and right side edges 60L and 60R each including an upwardly extending vertical plate portion 57 and a horizontal plate portion 58 which is bent to extend inwardly from the upper end thereof, leaving a rear end 59 (FIGS. 18 and 19). The rear end 59 of each of the left and right side edges 60L and 60R has a vertical plate portion 61 higher than the other vertical plate portion 57 and formed at the forward end thereof with a stepped portion 62. The height of the vertical plate portion 61 of the rear end 59 is less than the space between the horizontal plate portions 53 and 54 of the bracket elements 52L and 52R so that the shelf 51 may be slidably moved in generally forward and rearward directions between bracket elements 52L and 52R while the left and right side edges 60L and 60R are guided by vertical plate portions 63 of the bracket elements.

Figure 20:
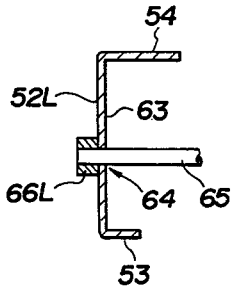
FIG. 20 is a fragmentary sectional view showing the construction in which a stopper pin is mounted on a bracket element.

Extending through holes 64 in substantially vertically central positions near the forward ends of the vertical plate portions 63 of the bracket elements 52L and 52R is a stopper pin 65 which is spaced above lower horizontal plate portions 53 by a distance less than the height of the rear ends 59 of the shelf 51. Locking rubber rings 66L and 66R are forced onto outwardly extended ends of the stopper pin as shown in FIG. 20 to prevent disengagement thereof. The holes 64 and the stopper pin 65 are located at a height slightly higher than the height of the vertical plate portions 57 of the left and right side edges 60L and 60R of the shelf 51.

Accordingly, in the state where the shelf 51 is drawn forwardly with respect to the bracket elements 52L and 52R as shown in FIG. 18, the stepped portions 62 of the left and right side edges 60L and 60R come into contact with the stopper pin 65 whereby the rear ends 59 of the shelf 51 are retained on the bracket elements 52L and 52R. However, since the height of the vertical plate portions 61 of the rear ends 59 of the left and right side edges 60L and 60R is less than the spacing between the horizontal plate portions 53, 54 of the bracket elements 52L and 52R, the shelf 51 inclines downwardly as it moves forwardly from the bracket elements 52L and 52R due to the weight of the forward portion thereof, whereby the upper surface thereof faces in a forward and upward direction. This state is maintained by bringing the stepped portions 62 of the rear ends 59 of the shelf 51 into contact with the pin 65, the bottom plate 67 into contact with forward ends of the lower horizontal plate portions 53 of the bracket elements 52L and 52R, and the rear upper ends 68 into contact with the inner surface of the upper horizontal plate portions 54 of the bracket elements 52L and 52R. To this end, the forward ends of the horizontal plate portions 53 are cut away partially.

The shelf 51 is formed at the forward end thereof with an upwardly extending receiving plate portion 71 whereby in the use state where the shelf 51 extends forwardly and downwardly, a cook-book placed on the upper surface of the shelf is supported from the bottom by portion 71.

On the other hand, riser elements 72L and 72R are formed at left and right portions in the lower surface of the forward end of the shelf 51, whereby when the shelf 51 is forced into the bracket elements 52L and 52R as shown in FIG. 19, elements 72L and 72R come into contact with the forward ends of the horizontal plate portions 53 at the lower sides of the bracket elements 52L and 52R. At this time, the shelf 51 tends to rotate downwardly and rearwardly due to the weight of the rear portion thereof, but the horizontal plate portions 58 of the left and right side edges 60L and 60R of the shelf 51 come into contact with the pin 65, whereby the shelf 51 is maintained in a substantially horizontal state with the bottom surface thereof supported on the rear ends of the bracket elements 52L and 52R.

The book holder constructed as shown in FIG. 16 is assembled in a manner as follows: First, the bracket elements 52L and 52R are secured by means of the screws 56 to the bottom plate 6 of the suspended shelf 5. The shelf 51 is inserted between the horizontal plate portions 53 and 54 of the bracket elements 52L and 52R, and thereafter the stopper pin 65 is extended through the holes 64 of the brackets 52L and 52R and the rubber rings 66L and 66R are forced onto the external extended portions of the pin, thus completing the assembly.

With the foregoing arrangement, when the book holder is used, a finger may be thrust into a finger hole 74 formed in the forward end of the shelf 51 to pull it out forwardly. In this state, when the hand is released from the shelf 51, the shelf 51 assumes the state shown in FIG. 18 in which the shelf has inclined forwardly due to the weight of the forward portion thereof. Then, the cook-book can be placed on the shelf 51 to direct the cook-book forwardly and upwardly so that the cook-book can be maintained in an easily readable orientation by a cook.

To change the mode for use to non-use, one can hold the forward end of the shelf 51 to raise it upwardly and at the same time the shelf may be forced rearwardly. At this time, the shelf 51 is brought into the horizontal state as shown in FIG. 19 due to the weight of the rear portion thereof, and thus the shelf 51 is housed under the bottom plate 6 of the suspended shelf 5.

In the use and non-use positions, the shelf 51 is held at the respective rear and forward ends thereof by means of the bracket elements having a ⊐-shaped section which embrace the left and right side edges 60L and 60R, whereby the use and non-use positions of the shelf 51 may be maintained positively and stably.

This eliminate the necessity of performing the operations of drawing out and pushing in of the shelf 51 with particular care.

Figure 21:
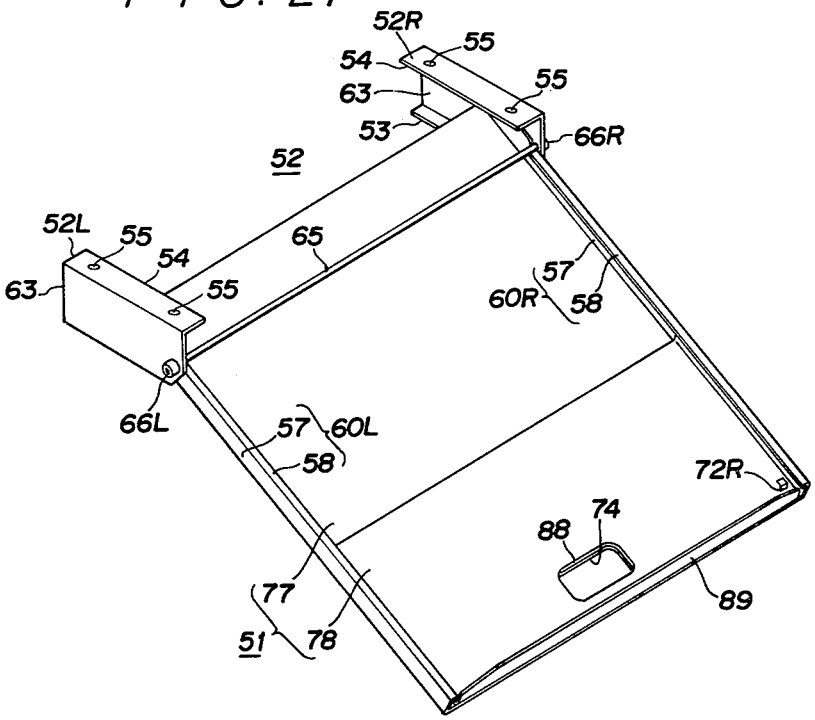
FIG. 21 is a perspective view showing a fourth embodiment of the book holder in accordance with the present invention.

FIG. 21 illustrates a fourth embodiment of a book holder in accordance with the present invention. This embodiment is different from the embodiment shown in FIG. 16 in that the forward end of the shelf 51 can telescope.

That is, the shelf 51 in this embodiment comprises a main shelf portion 77 of a construction similar to shelf 51 of FIG. 16, but with the receiving plate portion 71 thereof omitted, and an auxiliary shelf portion 78 laterally slidably mounted on the forward end of the main shelf portion 77.

Figure 23:
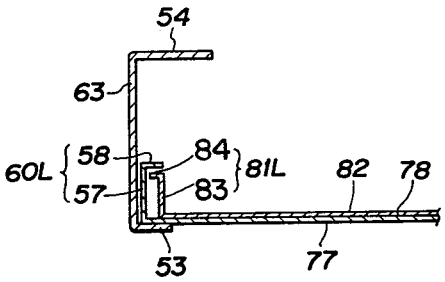
FIG. 23 is a fragmentary sectional view showing the relationship between the shelf and the bracket.

The auxiliary shelf portion 78 has a ⊓-shaped transverse section as shown in FIG. 23, and the auxiliary shelf portion 78 is fitted into the main shelf portion 77 so that left and right side edges 81L and 81R of the auxiliary shelf portion are slidably engaged with the left and right side edges 60L and 60R of the main shelf portion 77. Each of the left and right side edges 81L and 81R of the auxiliary shelf portion 78 includes a vertical plate portion 83 extending upwardly from respective left and right side edges of a bottom plate 82 and a horizontal plate portion 84 extending outwardly from the upper end of the vertical plate portion 83. A guide groove or opening 85 extends longitudinally and through vertical plate portion 83 in a substantially vertically central position at the forward end thereof as shown in FIGS. 24 and 25.

Engageable pins 86L and 86R are mounted, for example by caulking, on the forward ends of the vertical plate portions 57 of the left and right side edges 60L and 60R of the main shelf portion 77 and extend slightly inwardly therefrom. The engageable pins 86L and 86R engage in the guide grooves 85 in the vertical plate portions 83 of the left and right side edges 81L and 81R of the auxiliary shelf portion 78, whereby the auxiliary shelf portion 78 may be slidably moved to extend forwardly of the main shelf portion 77.

Figure 24:
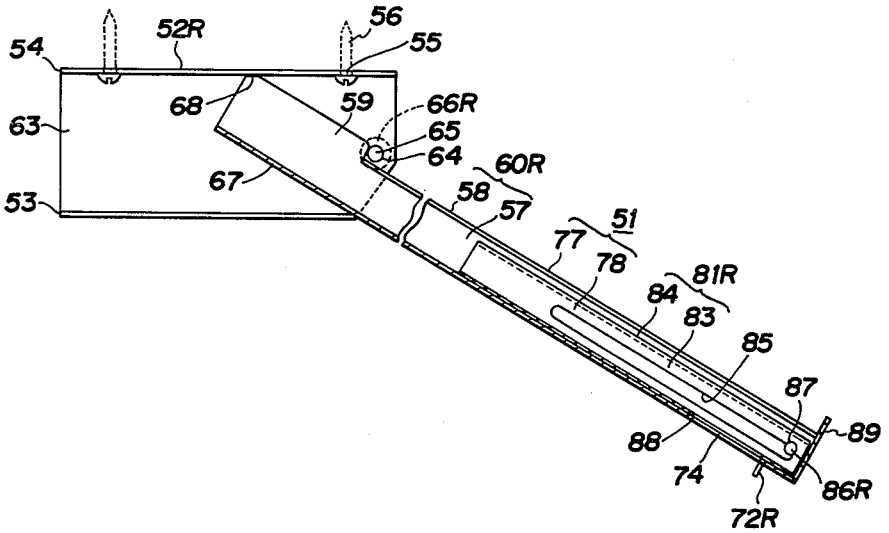
FIGS. 24 and 25 are longitudinal sectional views showing the relationship between the shelf in a use position and a non-use position, respectively, and the bracket.
Figure 25:
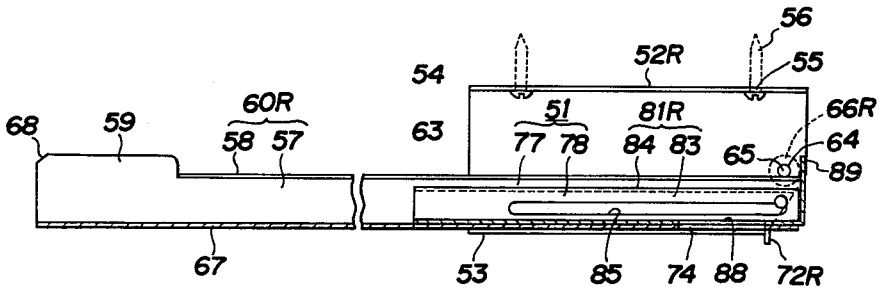
Figure 26:
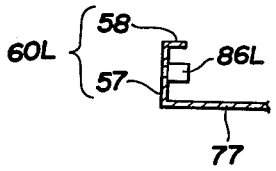
FIG. 26 is a fragmentary sectional view showing an engageable pin formed in a main shelf portion.

In this embodiment, each guide groove 85 is formed at the forward end thereof with an upwardly extending stopping groove 87 so that when the auxiliary shelf portion 78 is retracted into the main shelf portion 77 as shown in FIGS. 21 and 24, the engageable pins 86L and 86R are engaged with the stopping grooves 87, whereby the auxiliary shelf portion 78 stops at a position where the bottom plate is brought into contact with the bottom plate of the main shelf portion 77. At this time, a finger hole 88 of the auxiliary shelf portion 78 and finger hole 74 of the main shelf portion 77 are registered with and overlap each other. When the auxiliary shelf portion 78 is drawn forwardly from the main shelf portion 77, the engageable pins 86L and 86R are engaged with the guide grooves 85, whereby the auxiliary shelf portion 78 is raised upwardly so that the bottom plate of the auxiliary shelf portion 78 moves above the main shelf portion 77, and the horizontal plate portions 84 of the left and right side edges 81L and 81R come into contact with the horizontal plate portions 58 of the left and right side edges 60L and 60R of the main shelf portion 77, and finally the auxiliary shelf portion 78 is retained so as to extend in substantially the same direction as the extended direction of the main shelf portion 77.

The auxiliary shelf portion 78 is formed at the forward end with a receiving plate portion 89 so that when the auxiliary shelf portion 78 is retracted, a cook-book can be received at the forward position of the main shelf portion 77, whereas when extended, the cook-book can be received at a position extended forwardly of the main shelf portion 77.

Figure 27:
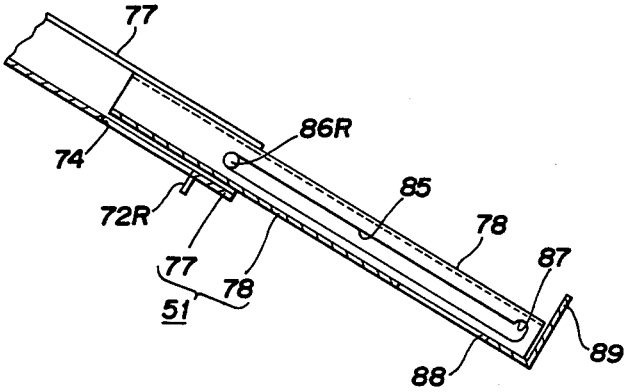
FIG. 27 is a fragmentary longitudinal sectional view showing the shelf in its extended position.

With the foregoing arrangement, in case of a small cook-book, the auxiliary shelf portion 78 remains retracted within the main shelf portion 77 for use (FIG. 24). On the other hand, in case of a large cook-book, the auxiliary shelf portion 78 is drawn forwardly from the main shelf portion 77 for use (FIG. 27). In this manner, similarly to the case as described above in connection with FIG. 16, the cook-book placed on the book-rest may be maintained in a position directed forwardly and upwardly without staining the cook-book or without hampering the cooking operation. When the auxiliary shelf portion 78 is drawn outwardly, the engageable pins 86L and 86R are engaged with the guide grooves 85, whereby the auxiliary shelf portion 78 may be supported so as to extend from the forward end of the main shelf portion 77 in the same direction as the extended direction thereof, in which case the cook-book also can be held positively and stably.

Thus, there is no necessity of performing the operation of drawing the auxiliary shelf portion 78 from the main shelf portion 77 with particular care.

Figure 22:
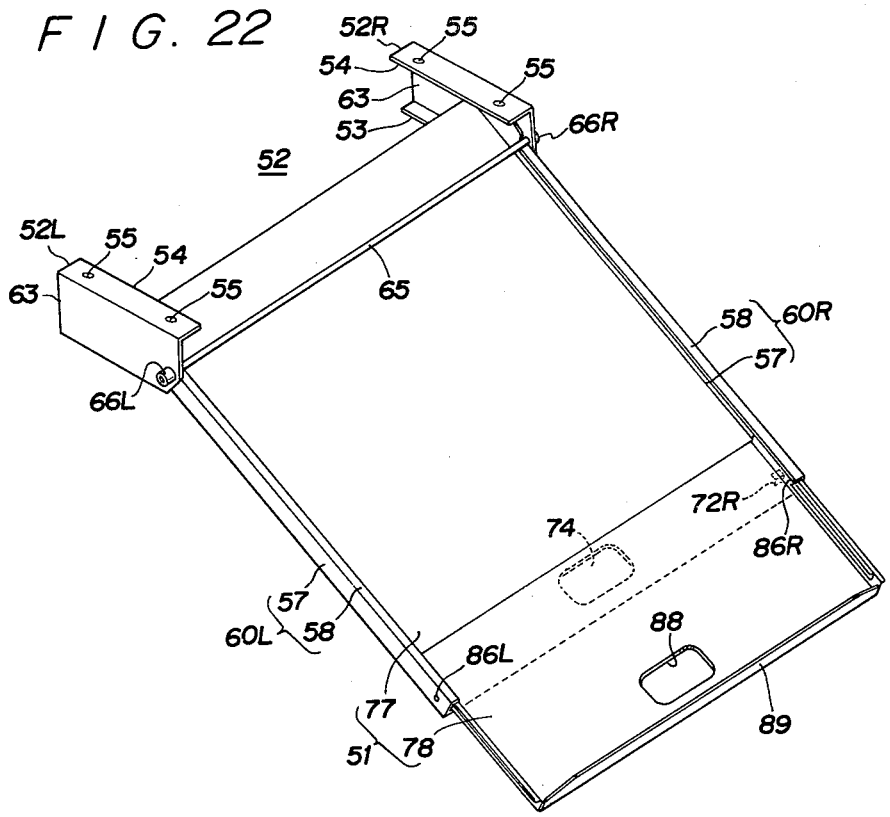
FIG. 22 is a perspective view showing a book holder in a condition where an auxiliary shelf portion is extended from a main shelf portion.

While in the embodiments shown in FIGS. 16 and 22, the description has been made of the case in which the bracket 52 is composed of the bracket elements 52L and 52R divided into two sections, it should be noted that instead of such arrangement the bracket may be formed, for example, to include a single upper horizontal plate portion 54. In this case, the stopper pin 65 can be divided into two sections which are extended slightly inwardly and from the left and right side walls.

Furthermore, while in the embodiments shown in FIGS. 16 and 22, the description has been made of the case in which the present invention is applied to a book holder for holding a cook-book, the present invention is not limited thereto but may be widely applied to other situations where a person stands before a work table to perform an operation while reading literature such as, for example, for the dispensation of a variety of drugs.

As described above, according to the structure shown in FIGS. 16 and 22, when the shelf 51 is drawn out from the bracket 52 secured to the mounting member, the rear end of the shelf 51 is supported on the bracket in a manner such that the shelf 51 is extended obliquely, forwardly and downwardly due to the weight of the forward portion thereof, whereby a relatively rigid and simple construction is provided and the literature may be held on the work table, whereas when not in use, the shelf 51 may be easily housed only by the simple manipulation of inserting the shelf into the bracket 52.

What is claimed is:

1. A book holder comprising:

a longitudinal shelf having an upper surface adapted to support an opened book, said shelf having forward and rearward ends and spaced opposite upwardly extending side edges;

a bracket supporting said shelf and adapted to be mounted to depend from a mounting body, said bracket including an upper horizontal plate portion and spaced vertical plate portions extending downwardly from opposite sides of said horizontal plate portion;

swivel mechanism means, extending through said horizontal plate portion, for mounting said bracket on a mounting body such that said bracket and thereby said shelf are rotatable about a generally vertical axis with respect to said swivel mechanism means and the mounting body;

means for mounting said rearward end of said shelf on said bracket such that said shelf is movable with respect to said bracket between a non-use position, whereat said shelf extends generally horizontally, and a use position, whereat said shelf extends downwardly from said bracket in a forwardly inclined manner, said mounting means comprising:

L-shaped openings formed in rear positions of said vertical plate portions;

generally horizontally extending slots formed in forward portions of said vertical plate portions;

a first shaft extending through rearward-most portions of said side edges of said shelf and having opposite ends slidably positioned in said L-shaped openings; and a second shaft extending through said side edges of said shelf at positions forwardly of said first shaft and having opposite ends slidably positioned in said horizontally extending slots; and wings attached to said side edges of said shelf in a manner to enable said wings to be folded over said upper surface of said shelf and folded laterally outwardly therefrom when said shelf is in said use position thereof.

2. A book holder as claimed in claim 1, wherein each said L-shaped opening includes a generally vertical portion and a generally horizontal portion extending forwardly from a lower end of said vertical portion.

3. A book holder as claimed in claim 2, wherein the forward end of each said horizontal portion is upwardly enlarged.

4. A book holder as claimed in claim 2, wherein when said shelf is in said non-use position said opposite ends of said first shaft are positioned at forward ends of respective said horizontal portions, and when said shelf is in said use position said opposite ends of said first shaft are at upper ends of respective said vertical portions.

* * * * *